US008132980B1

(12) United States Patent
Lee

(10) Patent No.: US 8,132,980 B1
(45) Date of Patent: Mar. 13, 2012

(54) SPIKE STRIP SYSTEM AND METHOD FOR DEPLOYING SAID SYSTEM FROM A VEHICLE

(76) Inventor: Justin D. Lee, Wellman, IA (US)

( * ) Notice: Subject to any disclaimer, the term of this patent is extended or adjusted under 35 U.S.C. 154(b) by 0 days.

(21) Appl. No.: 12/970,021

(22) Filed: Dec. 16, 2010

Related U.S. Application Data

(60) Provisional application No. 61/286,906, filed on Dec. 16, 2009.

(51) Int. Cl.
*E01F 13/12* (2006.01)

(52) U.S. Cl. ..... 404/6; 180/287

(58) Field of Classification Search ..... 404/6; 180/287
See application file for complete search history.

(56) References Cited

U.S. PATENT DOCUMENTS

| | | | | |
|---|---|---|---|---|
| 5,330,285 | A | 7/1994 | Greves et al. | |
| 5,611,408 | A * | 3/1997 | Abukhader | 180/287 |
| 5,820,293 | A | 10/1998 | Groen et al. | |
| 5,839,849 | A | 11/1998 | Pacholok et al. | |
| 5,921,704 | A | 7/1999 | Pacholok et al. | |
| 6,474,903 | B1 | 11/2002 | Marts et al. | |
| 6,527,475 | B1 | 3/2003 | Lowrie | |
| 6,623,205 | B1 | 9/2003 | Ramirez | |
| 7,275,889 | B1 * | 10/2007 | McGill | 404/6 |
| 7,377,715 | B2 | 5/2008 | Kruise | |
| 7,665,779 | B2 * | 2/2010 | Stock, Jr. | 293/118 |
| 7,824,126 | B2 * | 11/2010 | Costa | 404/6 |
| 2008/0124171 | A1 | 5/2008 | Moormeier et al. | |

* cited by examiner

*Primary Examiner* — Raymond Addie
(74) *Attorney, Agent, or Firm* — Montgomery Patent & Design, LLC; Robert C. Montgomery; Joseph T. Yaksich

(57) ABSTRACT

A system whereby a disabling spike strip is deployed from the rear undercarriage of a vehicle is enabled by a dashboard-mounted switch powered by the vehicle electrical system. The spike strip comprises a main body and two (2) extensions which are deployed outwardly from each side of the main body by the action of internal compression springs. The undersides of the main body and each extension are provided with a plurality of skid pads. The spike strip further comprises front and rear stabilizer bars. The purpose of the pads and the stabilizers are to retain the location of the spike strip against the pavement and against the action of a trailing vehicle's wheels. The top portion of the spike strip comprises a plurality of fixed and spring-loaded spikes being designed to shred the tires of the trailing vehicle.

19 Claims, 9 Drawing Sheets

SPIKE STRIP SYSTEM AND METHOD FOR DEPLOYING SAID SYSTEM FROM A VEHICLE

RELATED APPLICATIONS

The present invention was first described in and claims the benefit of U.S. Provisional Application No. 61/286,906 filed on Dec. 16, 2009, the entire disclosures of which are incorporated herein by reference.

FIELD OF THE INVENTION

The present invention relates generally to spike strip devices for deflating vehicle tires, and in particular, to a spike strip device readily deployable from a moving vehicle.

BACKGROUND OF THE INVENTION

Motor vehicle chases are a relatively rare but particularly trying part of law enforcement processes. High-speed chases involving law enforcement officers in pursuit of criminals provide a serious threat to the lives of the officers, the pursued, and bystanders unintentionally in the path of the chase. Thus the primary concern of law enforcement officers during such chases is to stop or disable the pursued vehicle as quickly as possible.

One (1) common method utilized in such situations is spike strips, which are installed on roads or streets at a location further ahead on the current path of the pursued vehicle. Such spike strips are effective at stopping a vehicle when the vehicle's tires come in contact with the spike strip. However, in many cases, such contact is typically unlikely as the fleeing vehicle may be aware of such practices and will have ample visual warning to avoid these strips.

Additionally, such spike strips are dangerous for the officers who are deploying them and may unintentionally endanger other law enforcement vehicles and the vehicles of innocent citizens.

Various attempts have been made to provide selectively deployable tire deflating systems. Examples of these attempts can be seen by reference to several U.S. patents. U.S. Pat. No. 5,839,849 issued in the name of Pacholok et al., describes a mechanical tire deflating device including a compressed gas deployment mechanism which release a projectile on a tether. Once fully deployed, the projectile automatically deploys a plurality of spike arms in order to disable a target vehicle.

U.S. Pat. No. 6,474,903, issued in the name of Marts et al., describes a barrier strip with a plurality of retractable tire-puncture spikes with a selectable control mechanism which allows a user to quick expose and lock the spikes and subsequent retract the spikes as desired.

U.S. Pat. No. 6,527,475, issued in the name of Lowrie, describes a quick stop deployment system and method which includes a pair of tire deflation systems deployable on either side of a vehicle in order to inhibit progress of a vehicle in an adjacent lane.

While these devices fulfill their respective, particular objectives, each of these references suffer from one (1) or more of the aforementioned disadvantages. Many such devices require the device to be pre-disposed at a fixed location prior to use. Also, many such devices do not cover a sufficiently broad area when deployed which may inhibit the effectiveness of the device. Furthermore, many such devices are difficult to deploy and to reset due to complex, non-reversible release mechanisms. In addition, many such devices are unstable when connected to a pursuit vehicle and pose danger to those operating the device. Accordingly, there exists a need for a deployable spike strip system without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a selectively deployable spike strip system for use with a moving vehicle which includes a simple and quick release and reset mechanism and a stable deployment process. Thus, the object of the present invention is to solve the aforementioned disadvantages and provide for this need.

To achieve the above objectives, it is an object of the present invention to comprise a spike strip system for deployment from a vehicle which allows selective disablement of a trailing vehicle, such as a law enforcement vehicle pursuing a fugitive vehicle. The system comprises a main body portion, first and second extension portions, and a pair of mounting brackets.

Another object of the present invention is to include a plurality of spikes which disable a trailing vehicle by damaging tire portions of the trailing vehicle including a plurality of upwardly extending spikes located on a top surface of the main body portion.

Yet still another object of the present invention is to securely fasten the system to an undercarriage frame of a vehicle using the pair of mounting brackets.

Yet still another object of the present invention is to allow a user to quickly release the main body portion and the first and second extension portions from the mounting bracket as desired. Each mounting bracket comprises a magnet further comprising an internal permanent magnet rotatably housed within a ferrous metal enclosure such that rotation of the internal permanent magnet provides deactivation of the magnetic attraction by the magnet upon an armature portion of a corresponding extension portion of the system, thereby causing the main body portion and the first and second extension portions to drop from the vehicle.

Yet still another object of the present invention is to allow the user to selectively deploy the main body portion and the first and second extension portions from within the vehicle. The system comprises a control module including a switch which is in electrical communication with a pair of rotary actuators attached to each mounting bracket. When the switch is manually actuated by the user, the magnets are rotated and the system is deployed as previously described.

Yet still another object of the present invention is to automatically extend the first and second extension portions upon deployment of the system using an internal spring-loaded deployment mechanism. Further upon extension of the first and second extension, a plurality of internal spring-loaded spikes are rotated upwardly through a plurality of correspondingly position rectangular spike slots in order to provide a spiked surface across the length of the system.

Yet still another object of the present invention is to provide stable, high-friction sliding against a pavement surface. The system further comprises a plurality of horizontally extending stabilizers and a plurality of downwardly disposed skid pads affixed to the main body portion and the first and second extension portions which provide the system with secure planar stability during deployment and when run over by the wheels of a trailing vehicle.

Yet still another object of the present invention is to provide a method of utilizing the device that provides a unique means of driving the leading vehicle to a location ahead of a trailing vehicle; selecting the "ON" position on the control module to deploy and jettison the main body and extension portions of the system onto the pavement into a path of the trailing vehicle; disabling the trailing vehicle wherein the tire portions of the trailing vehicle are punctured when traveling over the spike strip system; recovering the system; cleaning and repairing the system, if required; restoring the system to a ready state; and, benefiting from a mobile and compact means of deploying a spike strip to disable a trailing vehicle afforded a user of the system.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | spike strip system |
| 11 | main body |
| 12a | first extension |
| 12b | second extension |
| 13a | first stabilizer |
| 13b | second stabilizer |
| 13c | third stabilizer |
| 14a | first armature plate |

-continued

| DESCRIPTIVE KEY | |
|---|---|
| 14b | second armature plate |
| 15 | fixed spike |
| 16 | spring-loaded spike |
| 17 | first connector |
| 18 | second connector |
| 19 | main conductor |
| 20 | switch |
| 21 | male connector |
| 22 | female connector |
| 23 | control module |
| 24a | first magnet |
| 24b | second magnet |
| 25a | first rotary actuator |
| 25b | second rotary actuator |
| 26 | axle |
| 27 | spike slot |
| 28 | compression spring |
| 30 | backer plate |
| 31 | first extension stop |
| 32 | second extension stop |
| 34 | first skid pad |
| 35 | second skid pad |
| 36 | third skid pad |
| 37 | mounting bracket |
| 38 | aperture |
| 40 | existing vehicle electrical system |
| 60 | leading vehicle |
| 61 | pavement |
| 70 | trailing vehicle |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a spike strip system (herein described as the "system") 10, and a method for deploying said system 10 from a vehicle which in turn provides a means for disabling a trailing vehicle 70 from a leading deploying vehicle 60. The present invention is particularly suited for use when the leading deploying vehicle 60 is a law enforcement vehicle and the trailing vehicle 70 is a fugitive vehicle.

Figure 1:
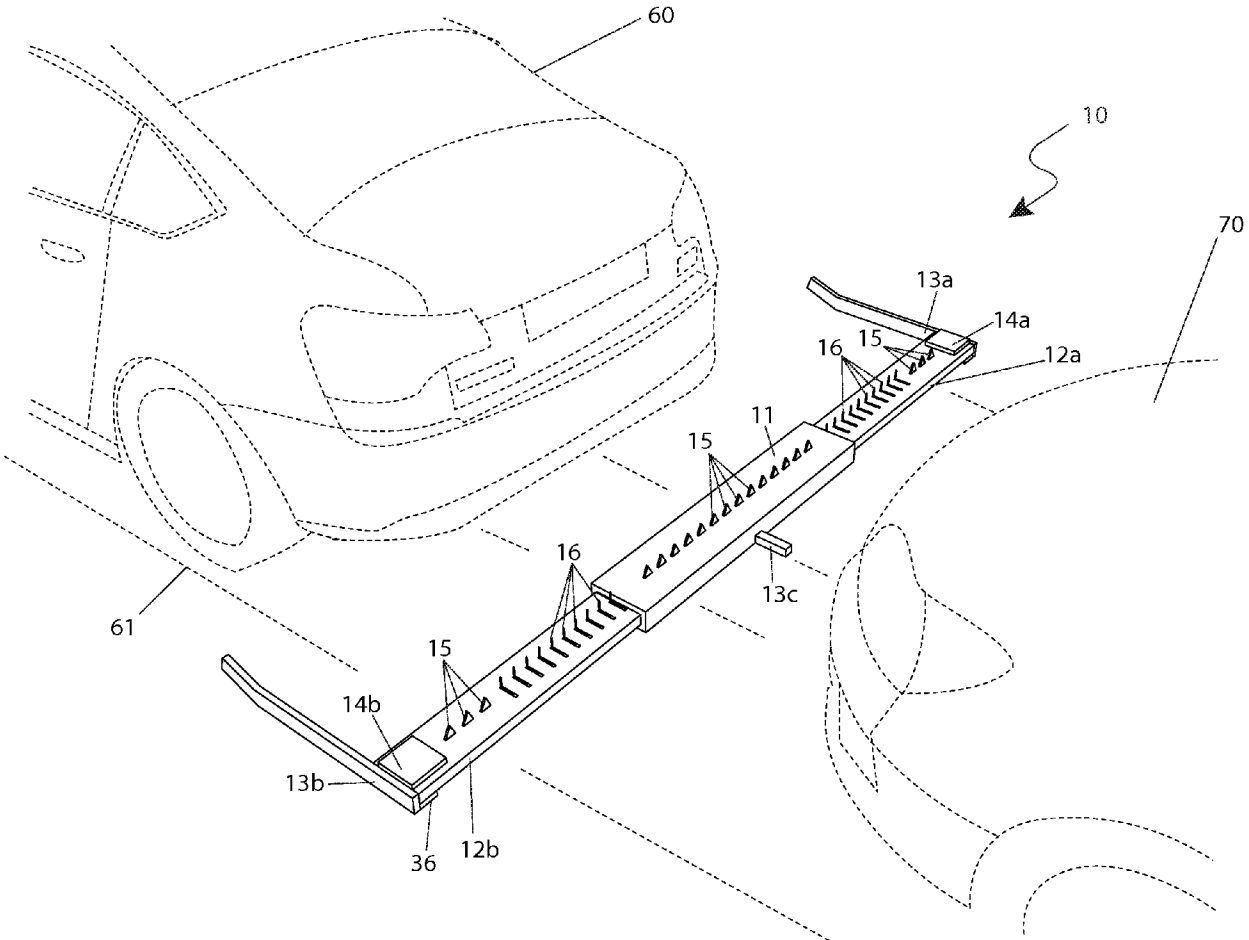
FIG. 1 is a perspective environmental view of a spike strip system 10 depicting a deployed state, according to a preferred embodiment of the present invention.

Referring now to FIG. 1, a perspective environmental view of the system 10, according to the preferred embodiment of the present invention, is disclosed. The system 10 is depicted in a state of having been jettisoned from an undercarriage portion of a moving leading vehicle 60 and deployed onto a subjacent pavement surface 61. The system 10 provides an effective means of disabling a trailing vehicle 70 by damaging tire portions of said trailing vehicle 70 via fixed spike portions 15 and raised spring-loaded spike portions 16 of the system 10. Said spring-loaded spikes 16 allow the system 10 to laterally collapse, thereby enabling compact storage under the leading vehicle 60 (see FIGS. 2 and 3*a*).

Figure 2:
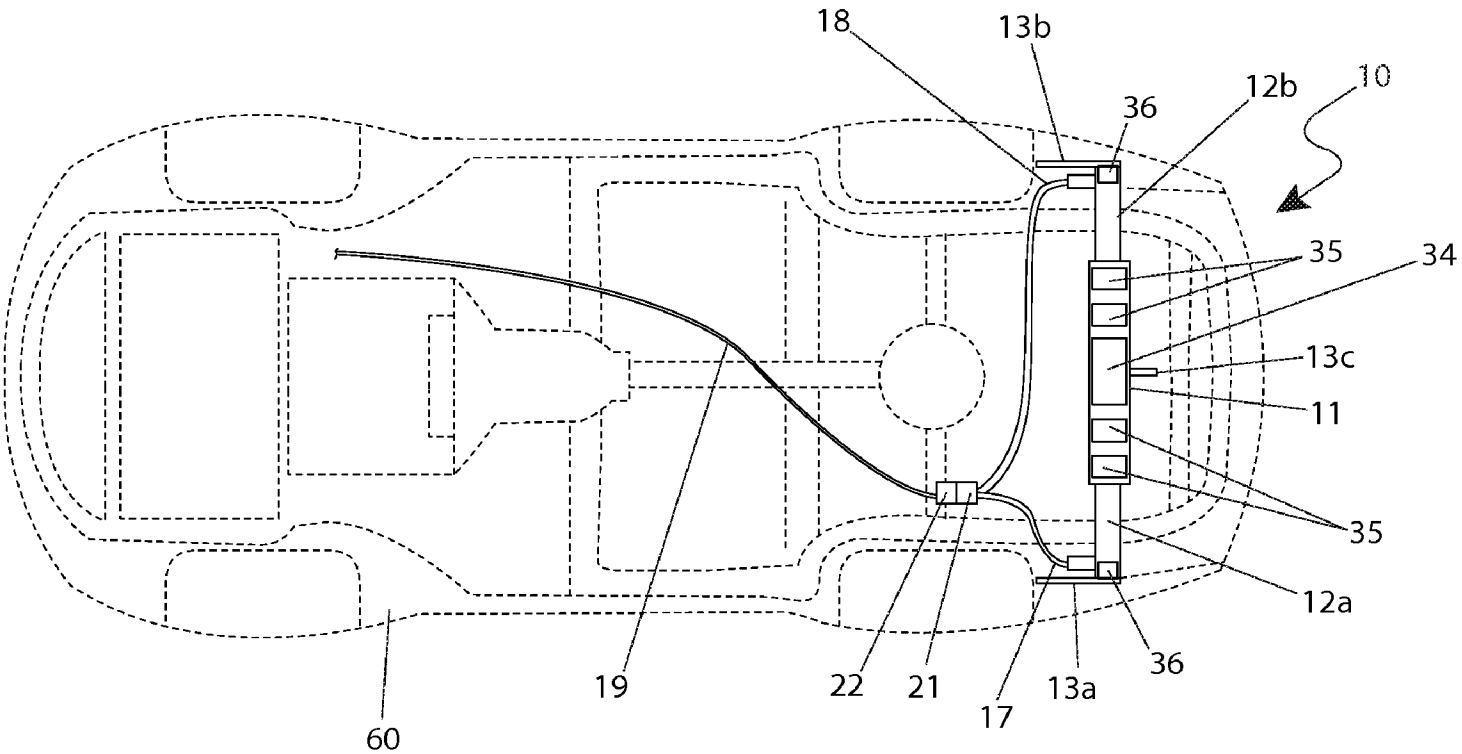
FIG. 2 is a bottom view of the spike strip system 10 in a ready state mounted upon a an undercarriage portion of a vehicle 60, according to the preferred embodiment of the present invention.

Referring now to FIG. 2, a bottom view of the system 10 mounted upon an undercarriage portion of a leading vehicle 60, according to the preferred embodiment of the present invention, is disclosed. The system 10 is depicted in a "ready" state wherein first extension 12*a* and second extension 12*b* portions are compactly retracted into a main body portion 11 of the system 10 and being transversely affixed to a rear undercarriage frame portion of the leading vehicle 60 via a pair of mounting brackets 37 (see FIGS. 3*a* and 3*b*).

Figure 3A:
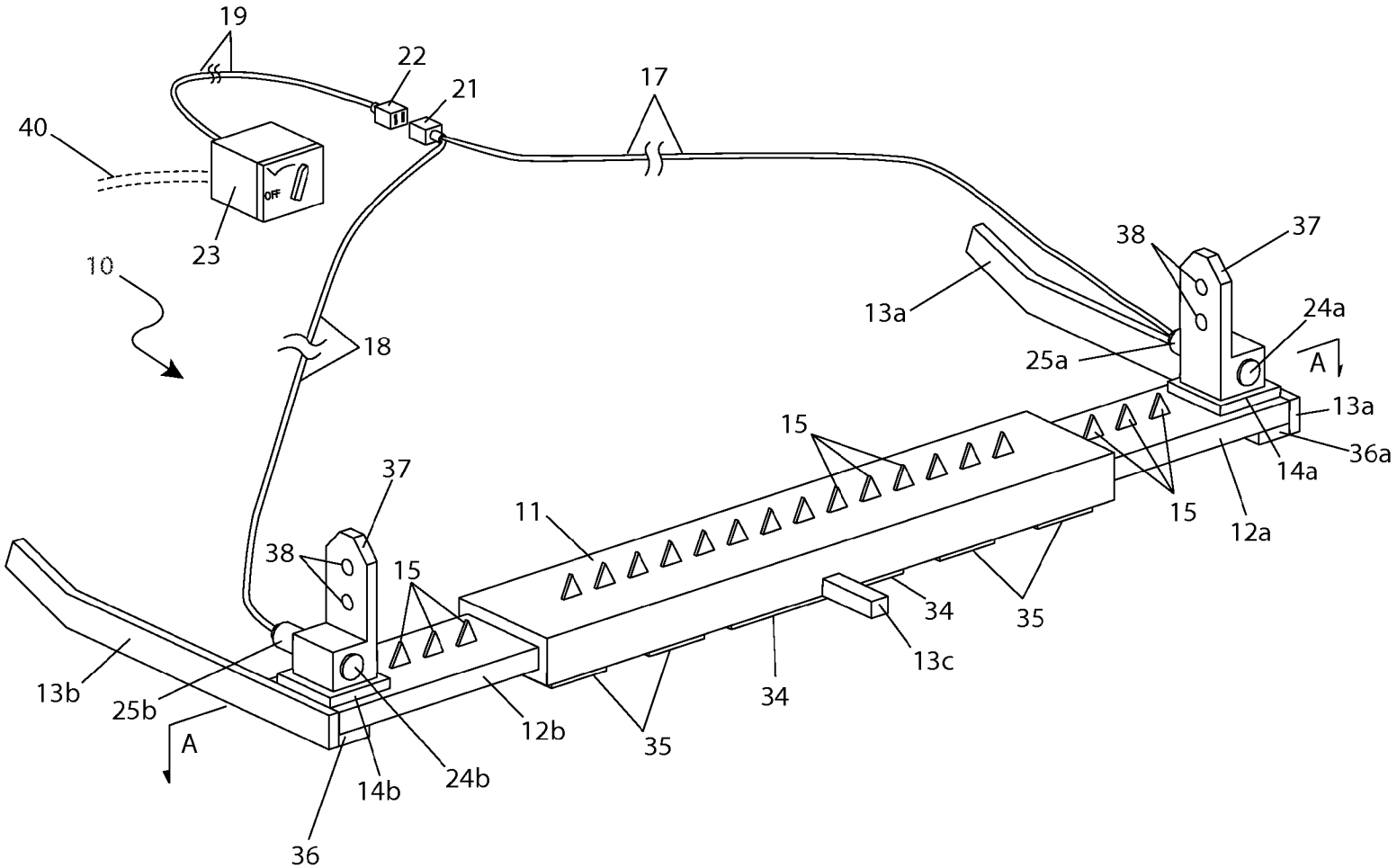
FIG. 3*a* is a perspective view of the spike strip system 10 in a ready state, according to the preferred embodiment of the present invention.

Referring now to FIG. 3*a*, a perspective view of the system 10 according to the preferred embodiment of the present invention, is disclosed. The system 10 is depicted here with both extension portions 12*a*, 12*b* secured in a retracted state and being retained by respective first magnet 24*a* and second magnet 24*b* portions, which in turn magnetically act upon subjacent first armature plate 14*a* and a second armature plate 14*b* portions, respectively. Said first 24*a* and second 24*b* magnets preferably provide a similar magnetic clamping function as a magnetic dial indicator base commonly used in machining and tool making industries, wherein a manual half-turn rotation of an internal permanent magnet housed within a ferrous metal enclosure, directs magnetism to a subjacent flat ferrous metal surface. Rotation of the magnet portions 24*a*, 24*b* of the system 10 is achieved via direct connection of said magnets 24*a*, 24*b* to corresponding electric first rotary actuator 25*a* and second rotary actuator 25*b* members being powered by an existing vehicle electrical system 40 of the leading vehicle 60. Rotation of said magnets 24*a*, 24*b* by said rotary actuators 25*a*, 25*b* provides activation or deactivation of the magnetic attraction exerted by said magnets 24*a*, 24*b* thereupon the corresponding armature plates 14*a*, 14*b*, thereby enabling the main body 11 and extension 12*a*, 12*b* portions of the system 10 to be selectively retained in the retracted state or to be released downwardly and deployed outwardly when needed. The armature plates 14*a*, 14*b* comprise flat rectangular magnetic mild steel plates approximately six (6) to eight (8) inches on a side and approximately one-half (½) to one (1) inch in thickness. Said armature plates 14*a*, 14*b* are preferably welded or otherwise fastened to top surfaces of each end portion of the extensions 12*a* and 12*b*, respectively.

Electrical power is conducted to the first 25*a* and second 25*b* rotary actuators by respective first wire 17 and second wire 18 portions in a synchronous manner via electrical connection to a selectable "ON" and "OFF" position upon a control module 23 being preferably mounted upon a dashboard portion of the leading vehicle 60. The system 10 comprises a male connector 21 which provides a molded body portion which acts to join said first 17 and second 18 wires at a proximal end as well as providing a common electrical connection to a mating female connector 22 upon a distal end portion. Said female connector 22 in turn comprises an integral single main conductor 19 which is routed to the aforementioned control module 23. In use, a user within the leading vehicle 60 may manually deploy the system 10 by utilizing a selector switch portion 20 of the control module 23. The joined and interconnected first 17 and second 18 wires provide a resultant simultaneous release of the armatures 14*a*, 14*b* from the magnets 24*a*, 24*b*, thereby resulting in downward release of the system 10 and horizontal extension of both extension portions 12*a*, 12*b*, thereby ensuring that the system 10 contacts the pavement 61 in a flat, straight and uniform manner.

Each magnet 24*a* and 24*b* is housed within an upwardly extending mounting bracket 37 which provides a means to securely fasten of the system 10 to undercarriage frame portions of the leading vehicle 60. The mounting brackets 37 are envisioned being made of a durable ferrous metal so as to effectively conduct the magnetism from the internal magnets 24*a*, 24*b* to the respective subjacent armature plates 14*a*, 14*b*. Said mounting brackets 37 are depicted here taking a form of "L"-shaped units comprising vertical plate portions further comprising a pair of fastening apertures 38 each; however, it is understood that various mounting brackets having different designs may be utilized to provide a fastening means to various makes and models of leading vehicles 60 onto which the system 10 may be applied and as such should not be interpreted as a limiting factor of the system 10.

The system 10 further comprises a main body 11, a first extension 12*a*, a second extension 12*b*, a first stabilizer 13*a*, a second stabilizer 13*b*, a third stabilizer 13*c*, a plurality of fixed spikes 15, and a plurality of spring-loaded spikes 16. The structures of the main body 11 and the extensions 12*a* and 12*b* are envisioned to be rectangular in cross section and fabricated, cast, molded or extruded of rugged metal materials such as, but not limited to: steel or aluminum, in either an internally reinforced box-like structure, a flattened tubular shape, or in a honeycomb-like structure to reduce weight. Outer end portions of each extension 12*a*, 12*b* comprise forwardly extending first 13*a* and second 13*b* stabilizer portions, respectively. Said first 13*a* and second 13*b* stabilizers are preferably welded to outer end surfaces of the respective extensions 12*a*, 12*b* and extend perpendicularly in a forward direction approximately eighteen (18) inches and being angled slightly upward at an end portion, thereby providing smooth sliding along an uneven paved surface 61. Furthermore, the system 10 comprises a third stabilizer 13*c* being permanently welded to a rear vertical surface of the main body 11 at an intermediate position. Said third stabilizer 13*c* is to extend in a rearward direction approximately six (6) to twelve (12) inches, thereby further enhancing a stable sliding motion. Said stabilizers 13*a*, 13*b*, 13*c* are envisioned to be made using rectangular bar stock of metal materials similar to those of the main body 11. The stabilizers 13*a*, 13*b*, 13*c* provide the system 10 with secure planar stability while sliding across pavement 61 as well as when being run over by the wheels of the trailing vehicle 70 during deployment.

The system 10 further comprises a plurality of fixed spikes 15 located along a top surface of the main body 11 and a portion of each extension 12*a*, 12*b* along a top surface which protrudes beyond the main body 11 when said extensions 12*a*, 12*b* are in the retracted state. Said fixed spikes 15 comprise pointed triangle-shaped protrusions approximately two (2) to three (3) inches in height being capable of piercing vehicle tires and are to be securely welded to said top surface portions of said main body 11 and the extension 12*a*, 12*b* portions.

Figure 3B:
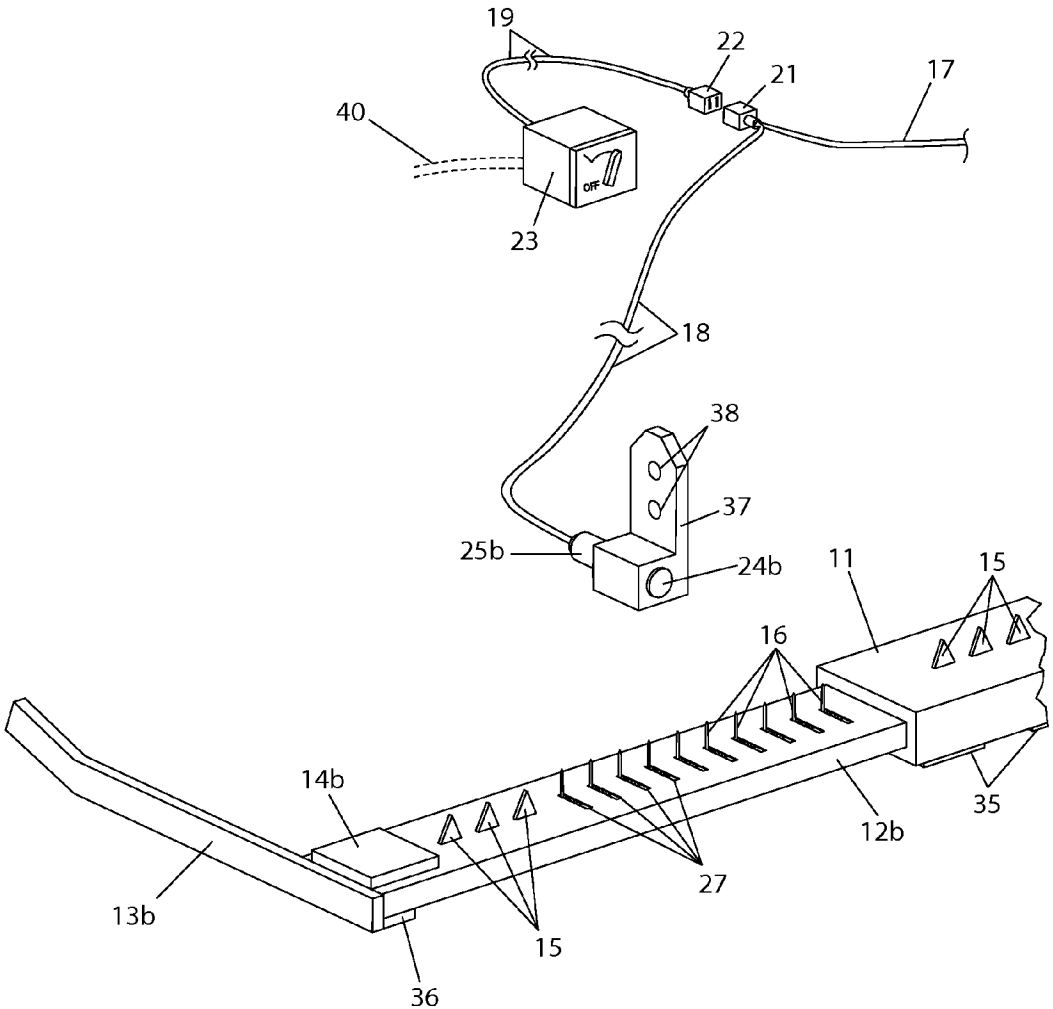
FIG. 3*b* is a perspective view of an end portion of the spike strip system 10 depicting a deployed state, according to the preferred embodiment of the present invention.

Referring now to FIG. 3*b*, a perspective view of the second extension 12*b* of the system 10 according to the preferred embodiment of the present invention, is disclosed. The second extension 12*b* is depicted here having been released and downwardly deployed from the corresponding second magnet 24*b*, and subsequently extended horizontally outward from the main body 11 by a force exerted by an internal compression spring 28 contained within said main body 11 (see FIG. 5*c*).

Figure 4:
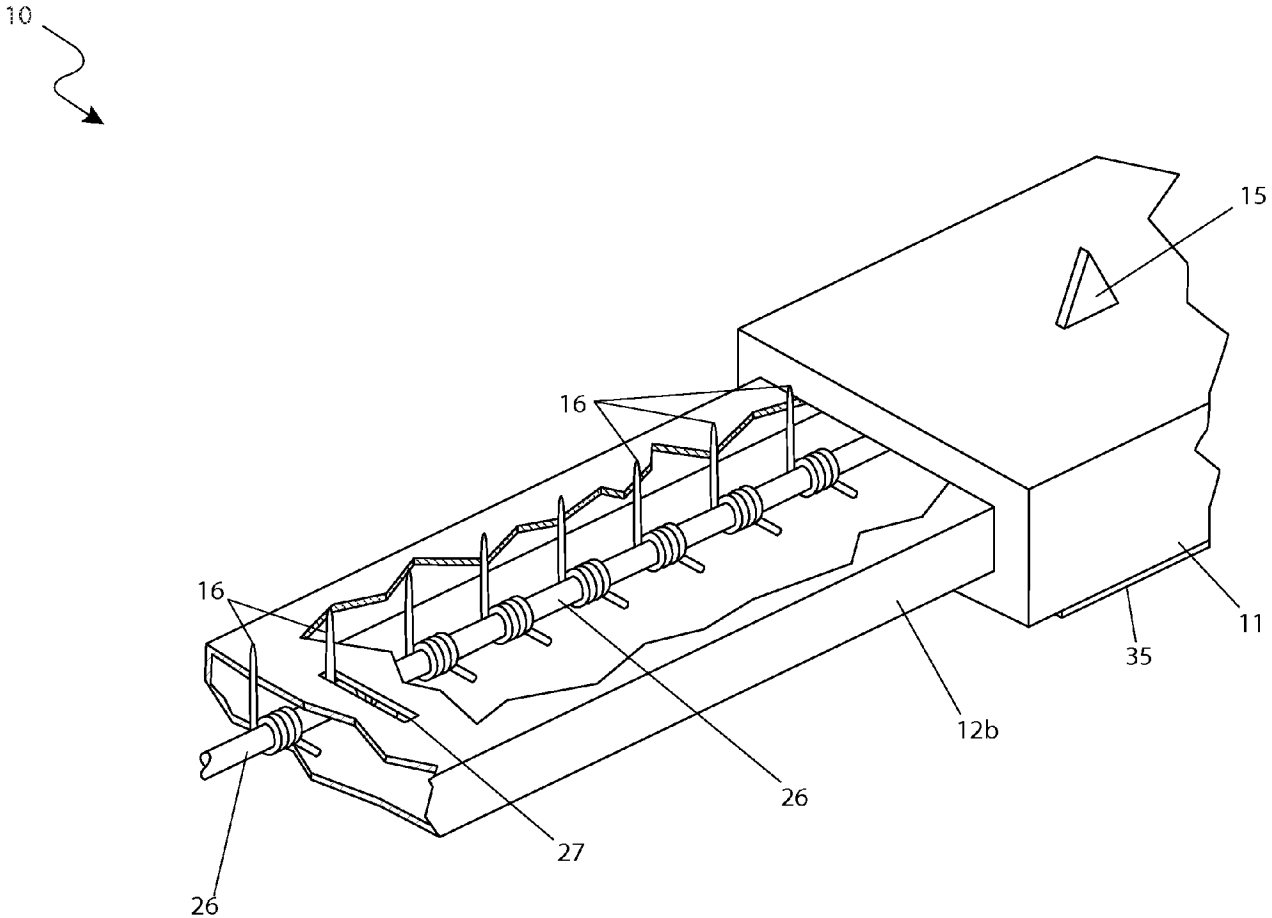
FIG. 4 is a close-up perspective view of spring-loaded spike portions 16 of the spike strip system 10, according to the preferred embodiment of the present invention.

Referring now to FIG. 4, a close-up perspective view of spring-loaded spike portions 16 of the system 10, according to the preferred embodiment of the present invention, is disclosed. The system 10 comprises a plurality of spring-loaded spikes 16 within a portion of each extension 12*a*, 12*b* which is recessed within the main body 11 when said extensions

12*a*, 12*b* are in the retracted state. Each spring-loaded spike 16 comprises a spiral wound torsional spring portion having a first protruding end portion shaped into a sharp spike configuration and a second end being braced against an interior portion of the respective extensions 12*a* and 12*b*. Each spring-loaded spike 16 is supported and laterally positioned by an axle 26 being inserted through each spring-loaded spike 16. Prior to activation and release of the system 10, the spring-loaded spikes 16 are retained in a depressed position against an inner surface of the main body 11. Upon release and horizontal extension of said extensions 12*a*, 12*b*, the spring-loaded spikes 16 are then free to rotate upwardly through correspondingly positioned rectangular-shaped spike slots 27 being machined or formed along top surfaces of the extensions 12*a*, 12*b*. Said spike slots 27 also provide a mechanical limitation to an upward rotation of said spring-loaded spikes 16 so as to retain said spring-loaded spikes 16 in a vertical orientation. Said spring-loaded spikes 16 protrude above a top surface of said extensions 12*a*, 12*b* approximately two (2) to three (3) inches being capable of piercing and shredding tire portions of the trailing vehicle 70.

Figure 5A:
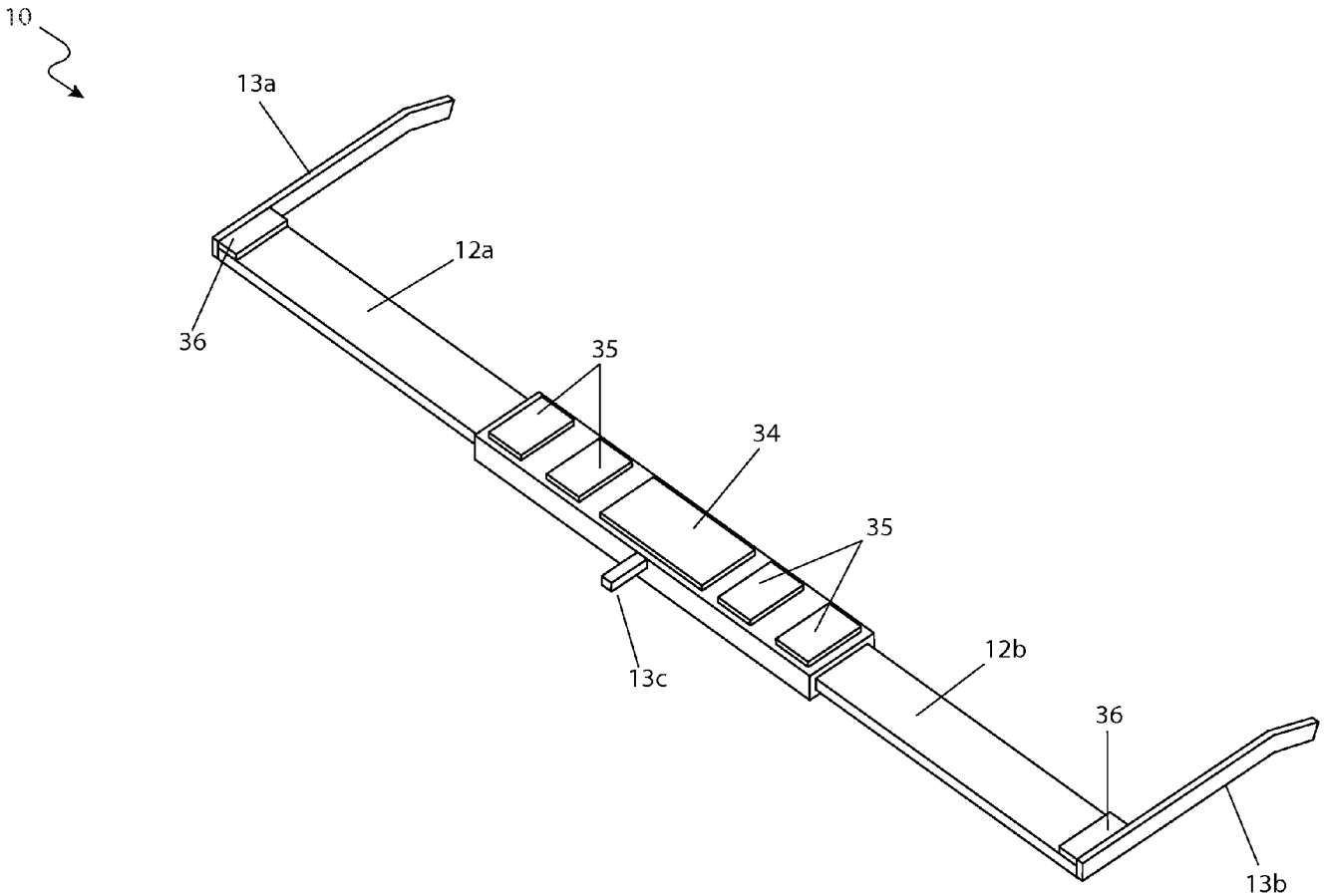
FIG. 5*a* is a perspective bottom view of the spike strip system 10 in a deployed state depicting skid pad portions 34, 35, 36, according to the preferred embodiment of the present invention.

Referring now to FIG. 5*a*, a perspective bottom view of the system 10 according to the preferred embodiment of the present invention, is disclosed. Underside portions of the main body 11 and both extensions 12*a*, 12*b* provide an increased friction and stabilizing means during contact with the pavement 61 upon deployment. Said main body 11 comprises a centrally located first skid pad 34 and four (4) second skid pads 35 being arranged along a bottom surface of said main body 11 so as to cover a majority of said surface area. Said extensions 12*a*, 12*b* further comprise respective third skid pads 36 being positioned adjacent to the aforementioned first 13*a* and second 13*b* stabilizers. Said pads 34, 35, 36 comprise various rectangular shapes being permanently bonded to the underside portions of the main body 11 and the extensions 12*a*, 12*b*. Said friction pads 34, 35, 36 are envisioned to be made of rubber, neoprene, or equivalent high-friction compounds having an appropriate durometer hardness, thereby providing a stable high-friction sliding action against the surface of the pavement 61.

Figure 5B:
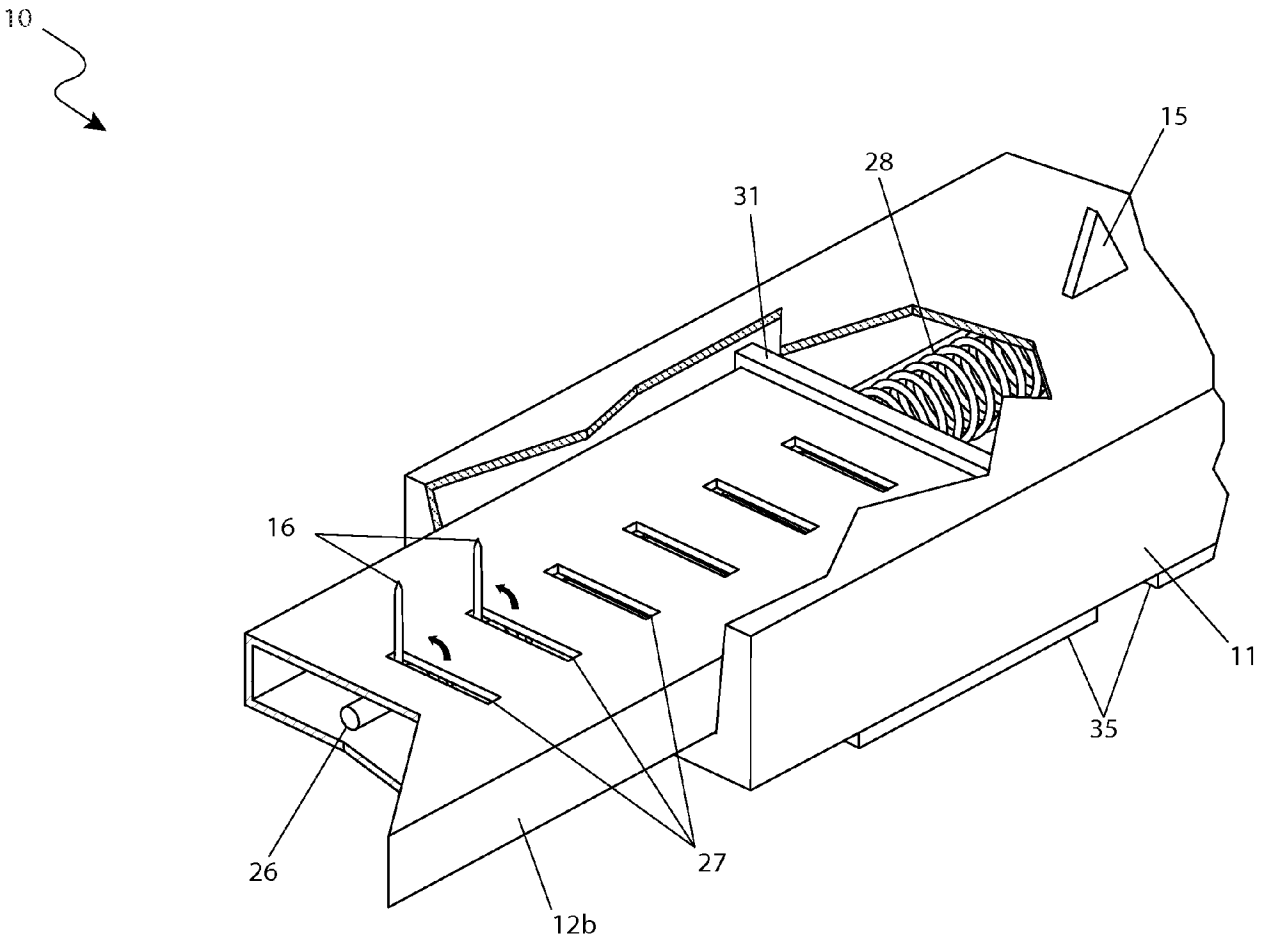
FIG. 5*b* is a partial cut-away view of main body 11 and second extension 12*b* portions of the spike strip system 10, according to the preferred embodiment of the present invention.

Referring now to FIG. 5*b*, a partial cut-away view of main body 11 and second extension 12*b* portions of the spike strip system 10, according to the preferred embodiment of the present invention is disclosed. The extensions 12*a*, 12*b* are insertingly and slidingly engaged into an inner cavity portion of the main body 11. A horizontal force to motion said extensions 12*a*, 12*b* outwardly is exerted via respective compression springs 28 (only the second extension 12*b* is shown here). Said compression springs 28 propel respective extensions 12*a*, 12*b* outwardly a distance of approximately sixteen (16) to twenty (20) inches upon release from the respective magnets 24*a*, 24*b*. Said outward motion of the extensions 12*a*, 12*b* is mechanically limited via internal contact of first extension stop portions 31 of said extensions 12*a*, 12*b* with second extension stop portions 32 of the main body 11 (see FIG. 5*c*).

The preferred method for securing and releasing the system 10 is disclosed herein utilizing magnetic devices; however, it is understood by those skilled in the art, that various means of retaining the system 10 onto the undercarriage of the leading vehicle 60, and ejecting the system 10 onto the pavement 61 may be utilized without deviating from the concept such as, but not limited to: various mechanically activated devices, electro-magnets, vacuum pad devices an electric pump, or the like.

Figure 5C:
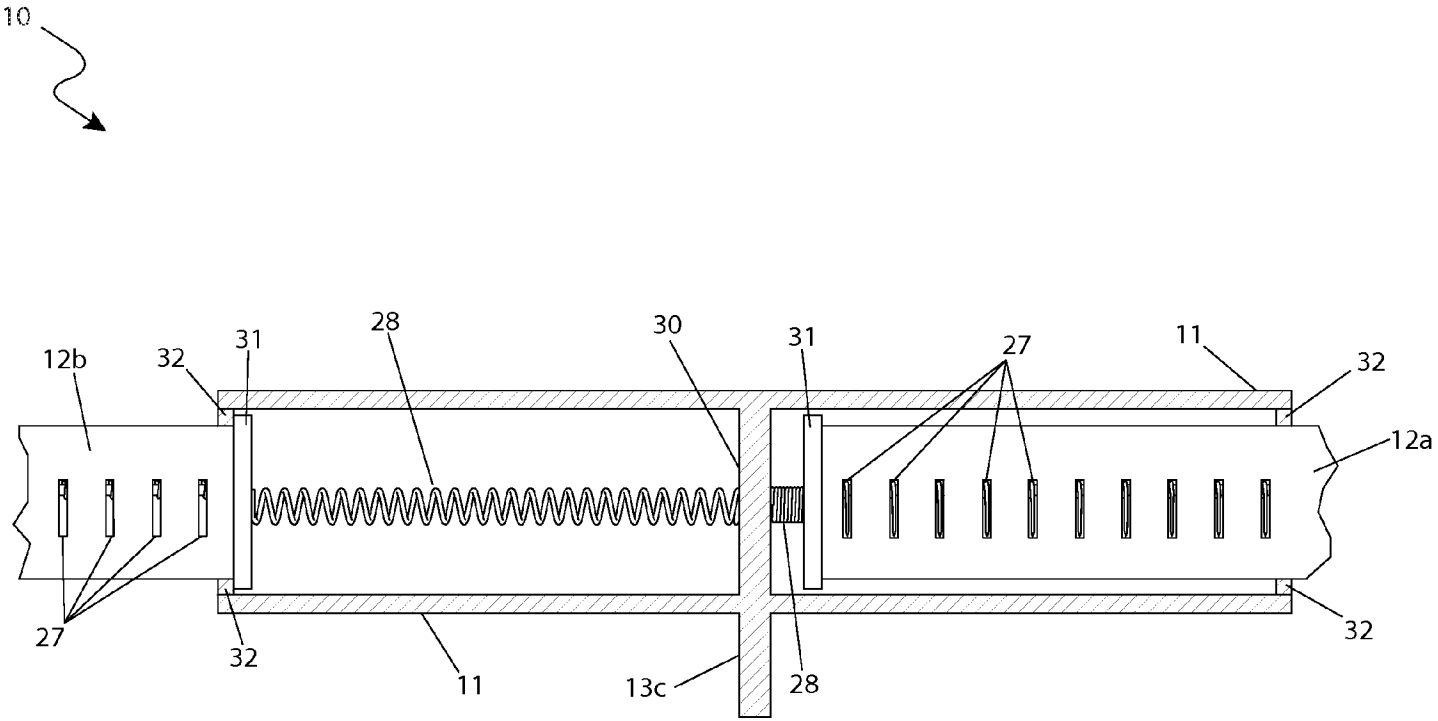
FIG. 5*c* is a section view of main body 11 and extension portions 12*a*, 12*b* of the spike strip system 10 taken along section line A-A (see FIG. 3*a*), according to the preferred embodiment of the present invention; and, FIG. 6 is an electrical block diagram of the spike strip system 10, according to the preferred embodiment of the present invention.

Referring now to FIG. 5*c*, a section view of main body 11 and extension portions 12*a*, 12*b* of the system 10 taken along section line A-A (see FIG. 3*a*), according to the preferred embodiment of the present invention, is disclosed. The first extension 12*a* is depicted here in a retracted state and the second extension 12*b* is depicted in an extended state for illustration sake. The retracted state of the first extension 12*a* provides mechanical retention of the spring-loaded spikes 16 within the spike slot portions 27 along the top surface of said first extension 12*a* and against a top surface of the main body 11 until said first extension 12*a* is deployed outwardly (see FIG. 5*b*). Said retracted state of said first extension 12*a* also results in compression of the compression spring 28 against an internal backer plate 30 being integral to the main body 11. Said backer plate 30 comprises an internal perpendicular wall structure, thereby separating an inner space of said main body 11 into two (2) equal chambers to contain the respective first 12*a* and second 12*b* extensions and corresponding compression springs 28.

The second extension 12*b* is depicted here being horizontally extended outward from the main body 11 having been released and thereby propelled via the force exerted by the compression spring 28. Outward extension of the extensions 12*a*, 12*b* is limited by mechanical contact between first extension stop portions 31 of the extensions 12*a*, 12*b*, and respective second extension stop portions 32 of the main body 11. Each first extension stop 31 comprises an integral portion of the extensions 12*a*, 12*b* and comprises a widened end portion of each extension 12*a*, 12*b* being contained within the main body 11. The second extension stops 32 comprise retaining rectangular openings at each end of the main body 11 being particularly sized to allow smooth inserted motioning of the extensions 12*a*, 12*b* while providing interference with said first extension stop portions 31, thereby retaining the system 10 in a fully deployed state during use.

Figure 6:
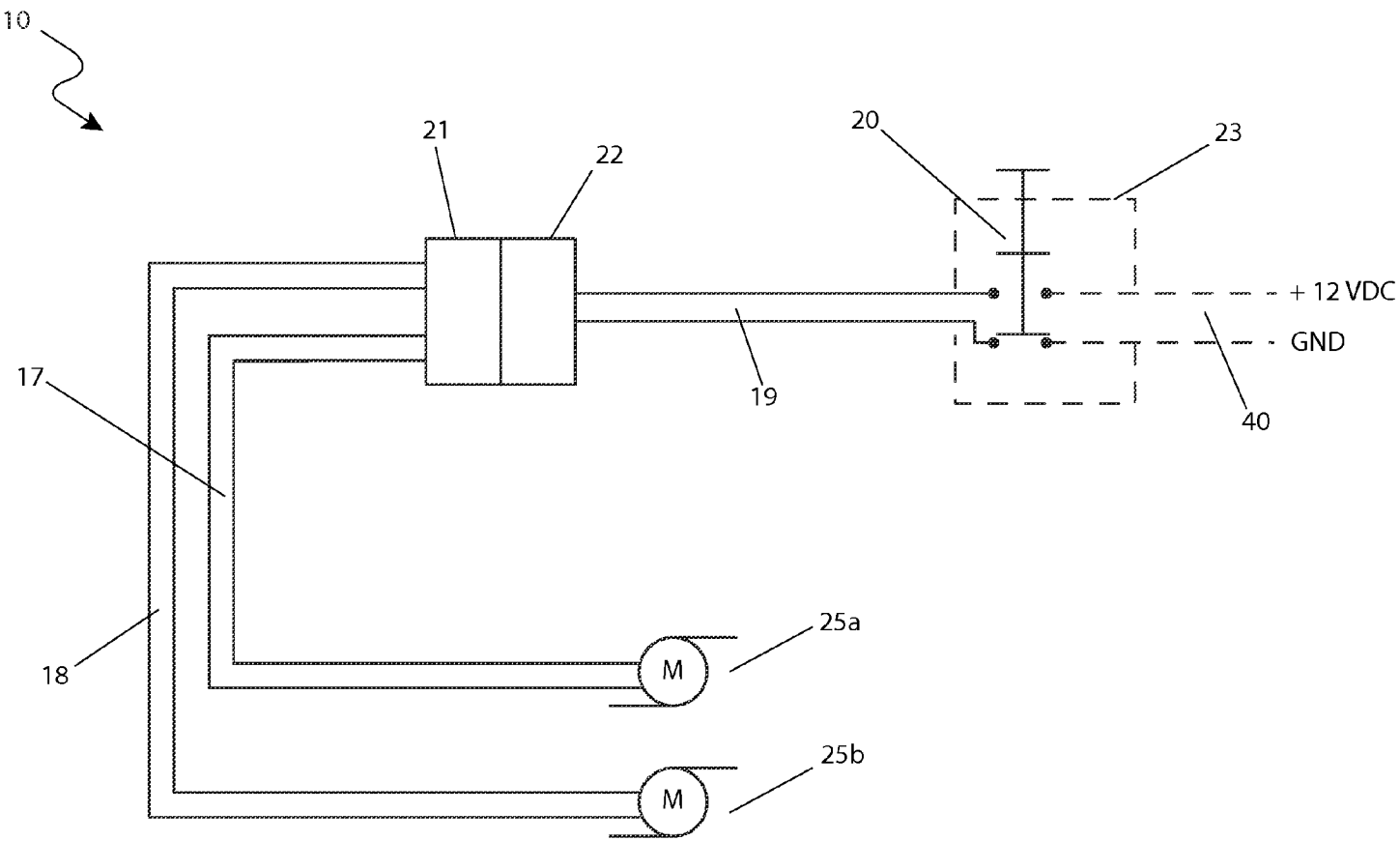

Referring now to FIG. 6, an electrical block diagram of the spike strip system 10, according to the preferred embodiment of the present invention, is disclosed. The system 10 utilizes polarized DC electrical power from an existing 12-volt vehicle electrical system 40. Said electrical power 40 is in turn controlled via a double pole-single throw type switch 20 within a control module 23 envisioned to be mounted within convenient reach by an operator driving the leading vehicle 60. Said switch 20 provides constant power to the first 25*a* and second 25*b* rotary actuators while the system 10 is in both "ready" and deployed states. Power is in turn conducted to the system 10 via a main conductor 19 being routed to a rear portion of the leading vehicle 60. Said main conductor 19 is in turn removably connected to the first 17 and second 18 wires via joining male 21 and female 22 connectors. Said female connector 22 provides a junction means to said first 17 and second 18 wires which are in turn connected to respective first 25*a* and second 25*b* rotary actuators, thereby providing power to said rotary actuators 25*a*, 25*b* in a synchronous manner to deploy the system 10 in a downward parallel manner upon the subjacent pavement 61.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 2.

The method of installing the system 10 to the leading vehicle 60 may be achieved by performing the following steps: procuring a model of the system 10 being suitable to a particular make and model of leading vehicle 60 onto which the system 10 is to be applied; fastening or welding the mounting brackets 37 to rear undercarriage frame portions of the leading vehicle 60 based upon requirements of a particular installation; routing and securing the first 17 and second 18 wires from the rotary actuators 25*a*, 25*b* along undercarriage frame portions of the leading deploying vehicle 60; mounting the control module 23 in a position within the leading vehicle 60 such as upon a dashboard area such that said control module 23 may be easily reached by the operator; providing electrical power to the system 10 by connecting the existing vehicle electrical system 40 within the dashboard to the control module 23; routing the main conductor 19 from the control module 23 along the undercarriage of the leading vehicle 60 to a location of the male connector 21; connecting the female connector portion 22 of the main conductor 19 to the male connector 21 portion of the first 17 and second 18 wires; and, mounting the extensions 12*a* and 12*b* and main body 11 portions of the system 10 to the mounting brackets 37 as described below.

The method of configuring the system 10 to the "ready" state may be achieved by performing the following steps: ensuring that the magnets 24*a* and 24*b* are deactivated by verifying that the control module 23 is set to the "OFF" position; raising the leading vehicle 60; placing a ratcheting strapping device horizontally around the system 10; operating the ratcheting device to progressively compress the compression springs 28 and retract the extensions 12*a* and 12*b* within the main body 11 while coincidentally and sequentially manually motioning the spring-loaded spikes 16 downwardly into the spike slots 27; raising and blocking the strapped system 10 so as to position the magnets 24*a*, 24*b* against the armature plates 14*a*, 14*b*; activating and securing said magnets 24*a* and 24*b* to said armature plates 14*a*, 14*b* by turning the control module 23 to the "ON" position; reversing the ratcheting device to release and remove a temporary retaining strap portion; and, lowering the deploying vehicle 60.

The method of utilizing the system 10 may be achieved by performing the following steps: driving the leading vehicle 60 to a location ahead of a trailing vehicle 70; selecting the "ON" position on the control module 23 to deploy and jettison the main body 11 and extension 12*a*, 12*b* portions of the system 10 onto the pavement 61 into a path of the trailing vehicle 70; disabling the trailing vehicle 70 wherein the tire portions of the trailing vehicle 70 are punctured when traveling over the spike strip system 10; recovering the system 10; cleaning and repairing the system 10, if required; restoring the system 10 to the "ready" state by following the steps described above; and, benefiting from a mobile and compact means of deploying a spike strip to disable a trailing vehicle 70 afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A spike strip system capable of being attached to a leading vehicle for disabling a trailing vehicle following the leading vehicle, said spike strip system comprising:

a main body;

a plurality of extensions engaged into said main body;

a plurality of fixed spikes connected to said extensions respectively;

a plurality of spring-loaded spikes releasably located at said extensions respectively;

a plurality of mounting brackets attached to said extensions respectively;

a plurality of armature plates attached to said extensions respectively;

a plurality of magnets attached to said mounting brackets and magnetically acting upon said armature plates respectively;

a plurality of rotary actuators communicatively coupled to said magnets; and, a control module communicatively coupled to said rotary actuators;

wherein said control module rotates said rotary actuators and thereby magnetically disengages said magnets from said armature plates in such a manner that said extensions are deployed from said mounting brackets.

2. The spike strip system of claim 1, further comprising:

first and second stabilizers extending perpendicularly in a forward direction from said extensions respectively; and, a third stabilizer connected to said main body.

3. The spike strip system of claim 1, wherein said main body comprises:

a plurality of internal compression springs located interior of said main body;

a plurality of skid pads located exterior of said main body; and, an internal backer plate anchored to said main body and thereby separating said main body in to a plurality of chambers, said internal backer plate being perpendicular to said internal compression spring;

wherein said compression springs exert a horizontal force thereby outwardly motion said extensions respectively.

4. The spike strip system of claim 3, wherein each of said extensions comprises:

an axle attached to one of said compression springs; and, a plurality of spike slots;

wherein a retracted state of said extensions retains said spring-loaded spikes within said main body until said extensions are deployed outwardly; and, wherein said retracted state of said extensions results in compression of said compression springs against said internal backer plate respectively.

5. The spike strip system of claim 1, wherein each said mounting brackets is made of a ferrous metal thereby conducting magnetism from said magnets to said one armature plate.

6. The spike strip system of claim 4, wherein said extensions are released and downwardly deployed from said magnets and subsequently extend horizontally outward from said main body by said compression springs respectively.

7. The spike strip system of claim 1, wherein said fixed spikes protrude beyond said main body when said extensions are in a retracted state.

8. The spike strip system of claim 4, wherein each of said spring-loaded spikes comprises:

a spiral wound torsional spring portion having a first protruding end portion and a second end braced against an interior portion of respective one of said extensions;

wherein said spring-loaded spikes are supported and laterally positioned along said axles respectively;

wherein said spring-loaded spikes are retained in a depressed position against an inner surface of said main body prior to deployment of said main body from the vehicle;

wherein said spring-loaded spikes freely rotate upwardly through said spike slots upon release and horizontal extension of said extensions respectively; and, wherein said spike slots limit an upward rotation of said spring-loaded spikes to a vertical orientation.

9. The spike strip system of claim 1, wherein said rotary actuators are connected to said mounting brackets and said control module respectively;

wherein said control module causes electrical power to be conducted to said rotary actuators and thereby simultaneously rotates said magnets respectively; and, wherein simultaneous rotation of said magnets simultaneously releases said armatures from said magnets, which downwardly deploys said main body and horizontally extends both extension relative to said main body.

10. A spike strip system capable of being attached to a leading vehicle for disabling a trailing vehicle following the leading vehicle, said spike strip system comprising:

a main body;

a plurality of extensions insertingly and slidingly engaged into said main body;

a plurality of fixed spikes connected to said extensions respectively;

a plurality of spring-loaded spikes releasably located at said extensions respectively;

a plurality of mounting brackets attached to said extensions respectively;

a plurality of armature plates attached to said extensions respectively;

a plurality of magnets attached to said mounting brackets and magnetically acting upon said armature plates respectively;

a plurality of rotary actuators communicatively coupled to said magnets; and, a control module communicatively coupled to said rotary actuators;

wherein said control module rotates said rotary actuators and thereby magnetically disengages said magnets from said armature plates in such a manner that said extensions are deployed from said mounting brackets.

11. The spike strip system of claim 10, further comprising:

first and second stabilizers extending perpendicularly in a forward direction from said extensions respectively; and, a third stabilizer connected to said main body.

12. The spike strip system of claim 10, wherein said main body comprises:

a plurality of internal compression springs located interior of said main body;

a plurality of skid pads located exterior of said main body; and, an internal backer plate anchored to said main body and thereby separating said main body in to a plurality of chambers, said internal backer plate being perpendicular to said internal compression spring;

wherein said compression springs exert a horizontal force thereby outwardly motion said extensions respectively.

13. The spike strip system of claim 12, wherein each of said extensions comprises:

an axle attached to one of said compression springs; and, a plurality of spike slots;

wherein a retracted state of said extensions retains said spring-loaded spikes within said main body until said extensions are deployed outwardly; and, wherein said retracted state of said extensions results in compression of said compression springs against said internal backer plate respectively.

14. The spike strip system of claim 10, wherein each said mounting brackets is made of a ferrous metal thereby conducting magnetism from said magnets to said one armature plate.

15. The spike strip system of claim 13, wherein said extensions are released and downwardly deployed from said magnets and subsequently extend horizontally outward from said main body by said compression springs respectively.

16. The spike strip system of claim 10, wherein said fixed spikes protrude beyond said main body when said extensions are in a retracted state.

17. The spike strip system of claim 13, wherein each of said spring-loaded spikes comprises:

a spiral wound torsional spring portion having a first protruding end portion and a second end braced against an interior portion of respective one of said extensions;

wherein said spring-loaded spikes are supported and laterally positioned along said axles respectively;

wherein said spring-loaded spikes are retained in a depressed position against an inner surface of said main body prior to deployment of said main body from the vehicle;

wherein said spring-loaded spikes freely rotate upwardly through said spike slots upon release and horizontal extension of said extensions respectively; and, wherein said spike slots limit an upward rotation of said spring-loaded spikes to a vertical orientation.

18. The spike strip system of claim 10, wherein said rotary actuators are connected to said mounting brackets and said control module respectively;

wherein said control module causes electrical power to be conducted to said rotary actuators and thereby simultaneously rotates said magnets respectively; and, wherein simultaneous rotation of said magnets simultaneously releases said armatures from said magnets, which downwardly deploys said main body and horizontally extends both extension relative to said main body.

19. A method of utilizing a spike strip system attached to a leading vehicle for disabling a trailing vehicle following the leading vehicle, said method comprising the steps of:

providing a main body;

providing a plurality of extensions;

insertingly and slidingly engaging said extensions into said main body;

providing and connecting a plurality of fixed spikes to said extensions respectively;

providing and releasably locating a plurality of spring-loaded spikes at said extensions respectively;

providing and attaching a plurality of mounting brackets to said extensions respectively;

providing and attaching a plurality of armature plates to said extensions respectively;

providing and attaching a plurality of magnets to said mounting brackets;

providing and communicatively coupling a plurality of rotary actuators to said magnets;

providing and communicatively coupling a control module to said rotary actuators;

said magnets magnetically acting upon said armature plates respectively; and, said control module rotates said rotary actuators and thereby magnetically disengages said magnets from said armature plates in such a manner that said extensions are deployed from said mounting brackets.

* * * * *